US005697352A

United States Patent [19]

Shimizu et al.

[11] Patent Number: 5,697,352

[45] Date of Patent: Dec. 16, 1997

[54] IGNITION APPARATUS FOR INTERNAL COMBUSTION ENGINE

[75] Inventors: Takeshi Shimizu; Mitsuru Koiwa, both of Tokyo, Japan

[73] Assignee: Mitsubishi Denki Kabushiki Kaisha, Tokyo, Japan

[21] Appl. No.: 607,370

[22] Filed: Feb. 27, 1996

[30] Foreign Application Priority Data

Apr. 24, 1995 [JP] Japan ..... 7-098807

[51] Int. Cl.[6] ..... F02P 3/02

[52] U.S. Cl. ..... 123/634; 361/268

[58] Field of Search ..... 123/634, 635, 123/647; 361/268

[56] References Cited

U.S. PATENT DOCUMENTS

| | | | |
|---|---|---|---|
| 4,198,943 | 4/1980 | Wörz | 123/647 |
| 4,248,201 | 2/1981 | Tsutsui et al. | 123/634 |
| 4,979,486 | 12/1990 | Shimada et al. | 123/635 |
| 5,146,882 | 9/1992 | Brinkman et al. | 123/634 |
| 5,365,909 | 11/1994 | Sawazaki et al. | 123/635 |

FOREIGN PATENT DOCUMENTS 6-299939 10/1994 Japan .

*Primary Examiner*—Andrew M. Dolinar

*Attorney, Agent, or Firm*—Sughrue, Mion, Zinn, Macpeak & Seas, PLLC

[57] ABSTRACT

In an ignition apparatus for an internal combustion engine, to reduce the size of the apparatus and improve the layout property for mounting the apparatus and a radiating property of the apparatus, a primary coil 2 and a secondary coil 4 are concentrically wound around the center core 6*a* of a magnetic core 6 of a closed magnetic circuit and accommodated in an outer case 15. A module accommodating portion 15*a* is provided with the outer case 15 and located at a position where it is overlapped with the side core 6*b* of the core 6 in a direction perpendicular to a surface of the closed magnetic circuit formed by the core 6 (axial direction of the core 6). Further, a connector 8 which feeds a primary current from an external power unit to the primary coil 2 is disposed integrally with the outer case 15 at a position where it is overlapped with the center core 6*a* in the axial direction of the core 6 as well as overlapped with the module accommodating portion 15*a* in a direction perpendicular to the axial direction of the core 6.

6 Claims, 11 Drawing Sheets

IGNITION APPARATUS FOR INTERNAL COMBUSTION ENGINE

BACKGROUND OF THE INVENTION

1. Field of the Invention

The present invention relates to an ignition apparatus for an internal combustion engine for feeding a high-tension voltage to an ignition plug using a switching module for controlling a primary current to be intermittently fed in accordance with an ignition timing.

2. Description of the Related Art

FIG. 9 is a front view showing a conventional ignition apparatus for an internal combustion engine described in, for example, Japanese Utility Model Application Laid-Open No. 4-59118 with a molding resin removed, and FIG. 10 is a side cross sectional view showing the conventional ignition apparatus for an internal combustion engine of FIG. 9.

In the drawings, a primary bobbin 1 is formed to a cylindrical shape using a resin material such as, for example, PBT (polybutylene terephthalate). A primary coil 2 is formed by winding a conductor around the outer peripheral surface of the primary bobbin 1. Further, a secondary bobbin 3 formed to a cylindrical shape using a resin material such as PBT (polybutylene terephthalate) is concentrically disposed externally of the primary bobbin 1. A comb-teeth-shaped irregular portion is formed on the outer peripheral surface of the secondary bobbin 3 and a secondary coil 4 is formed by winding a conductor in the recess of the irregular portion. Note, the number of turns of the secondary coil 4 is set to about one hundred times that of the primary coil 2. The primary coil 2 and secondary coil 4 are accommodated in an outer case 5 formed of PBT together with both the primary bobbin 1 and secondary bobbin 3 concentrically disposed as described above.

As shown in FIG. 11, a magnetic core 6 of a closed magnetic circuit is composed of a center core **6*a* and a side core 6*b* which are disposed in parallel with each other and arranged to an annular shape in such a manner that the both ends of the center core 6*a* and the side core 6*b* are connected to each other by connecting cores 6*c*, 6*c*. The core 6 is disposed so that the center core 6*a* passes through the primary bobbin 1 and the outer case 5 to magnetically couple the primary coil 2 with the secondary coil 4. The outer case 5 has a module accommodating portion 7 disposed externally of the secondary bobbin 3 and a connector 8 disposed externally of the module accommodating portion 7, these the module accommodating portion 7 and connector 8 being disposed in a direction perpendicular to a surface of the closed magnetic circuit formed by the core 6 (hereinafter, referred to as the axial direction of the core 6) so as to be overlapped with the center core 6. The module accommodating portion 7 of the outer case 5 accommodates a switching module 9 which intermittently feeds a primary current to be fed to the primary coil 2 in accordance with an ignition timing. A high-tension tower 10 is disposed integrally with the outer case 5 on the side opposite to the connector 8 across the center core 6*a* of the core 6. The interior of the outer case 5 in which the primary bobbin 1, secondary bobbin 3, switching module 9 and the like are accommodated is filled with a molding resin 11** composed of insulation resin such as, for example, epoxy resin.

One end of the primary coil 2 is connected to the switching module 9 and the other end thereof is connected to one end of the secondary coil 4 as well as to the external terminal **8*a* of the connector 8. Further, the other end of the secondary coil 4 is connected to the high-tension terminal 10*a* of the high-tension tower 10**.

The switching module 9, connector 8 and high-tension tower 10 are disposed to be overlapped in the axial direction of the core 6 across-the center core **6*a* of the core 6. The switching module 9 is located at an intermediate position between the secondary coil 4 and the connector 8 and about one half the surface area of the switching module 9 is disposed along the periphery of the outer case 5**.

Next, operation of the conventional ignition apparatus for an internal combustion engine will be described.

When a primary current is fed to the primary coil 2 from an external power unit (not shown) through the external terminal **8*a* of the connector 8, magnetic flux is generated in the core 6. When the primary current fed to the primary coil 2 is interrupted by the switching module 9 in accordance with an ignition timing of an internal combustion engine, a high-tension voltage is generated to the secondary coil 4 by the magnetic induction phenomenon in accordance with the turn ratio of the primary coil 2 to the secondary primary 4. The high-tension voltage generated to the secondary coil 4 is output through the high-tension terminal 10*a* of the high-tension tower 10. Then, an ignition plug connected to the high-tension terminal 10*a* of the high-tension tower 10** causes discharging to operate the internal combustion engine.

With the series of operation, heat is generated at the current feed units such as the primary coil 2, secondary coil 4 and switching module 9. Although the generated heat is radiated to the outside through the molding resin 11 in the periphery of the current feed units and the outer case 5, heat is accumulated at portions where the current feed units confront each other.

Further, the high-tension units such as the secondary coil 4 and the high-tension terminal **10*a* of the high-tension tower 10 are insulated from the low-tension units such as the primary coil 2 and the core 6 by the molding resin 11**.

As described above, since the conventional ignition apparatus for an internal combustion engine is arranged such that the switching module 9, connector 8 and high-tension tower 10 are disposed to be overlapped in the axial direction of the core 6 across the center core **6*a* of the core 6, the apparatus must be shaped inefficiently. Further, since a large space must be set between the switching module 9** and the coil unit, which are heat generating units, so as to secure a heat radiation property, the outside shape of the apparatus is increased accordingly. Thus, the conventional ignition apparatus for an internal combustion engine has a problem in that it is liable to be restricted by the periphery of a portion where the apparatus is to be mounted and a layout property for mounting the apparatus is lowered.

Further, when it is desired to reduce the size of the apparatus in this arrangement, the primary coil 2, secondary coil 4 and switching module 6 which are the heat generating units must be located close to each other. Moreover, a problem also arises in that since the switching module 9 is located at the intermediate position between the secondary coil 4 and the connector 8 and only about one half the surface area of the switching module 9 is located close to the outer wall of the outer case 5, the area to which other components are closely located is increased and it is difficult for the heat generated at these heat generating units to escape to the exterior.

SUMMARY OF THE INVENTION

An object of the present invention made to solve the above problems is to provide an ignition apparatus for an internal combustion engine in which the size of the apparatus is reduced and the degree of freedom in layout of the apparatus is improved while still achieving an excellent heat radiating property.

In order to achieve the above object, according to one aspect of the present invention, there is provided an ignition apparatus for an internal combustion engine, which comprises a magnetic core of a closed magnetic circuit arranged to an annular shape by connecting a center core to a side core by connecting cores at both ends thereof, a primary coil wound around the center core of the core, a secondary coil concentrically wound externally of the primary coil, an outer case for accommodating the center core, the primary coil and the secondary coil, a molding resin filled in the outer case, a connector having an external terminal electrically connected to the primary coil and feeding a primary current from an external power unit, a switching module for intermittently feeding the primary current in accordance with an ignition timing, the switching module being located at a position where it is overlapped with the side core of the core as viewed in the axial direction of the core, and a high-tension tower having a high-tension terminal electrically connected to the secondary coil and outputting a high-tension voltage.

DESCRIPTION OF PREFERRED EMBODIMENTS

Embodiment 1

Figure 1:
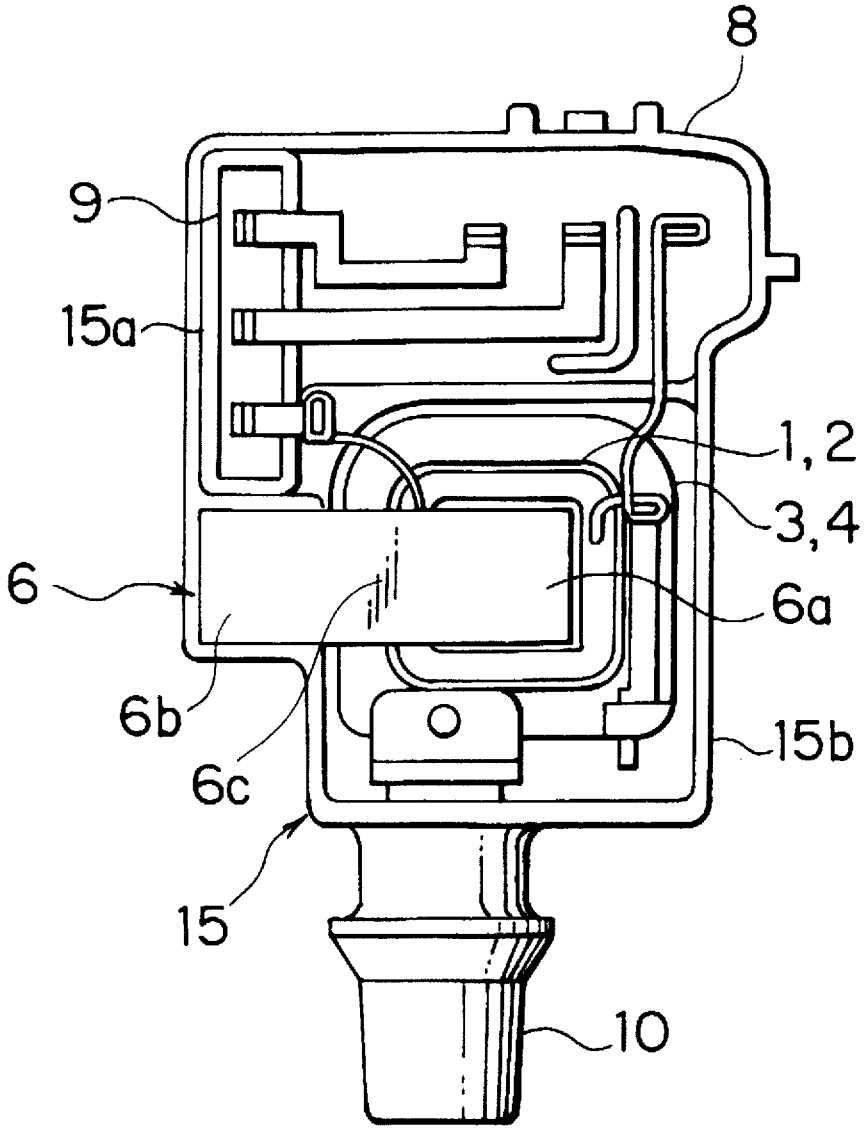
FIG. 1 is a front view showing an ignition apparatus for an internal combustion engine according to an embodiment 1 of the present invention with a molding resin removed.
Figure 2:
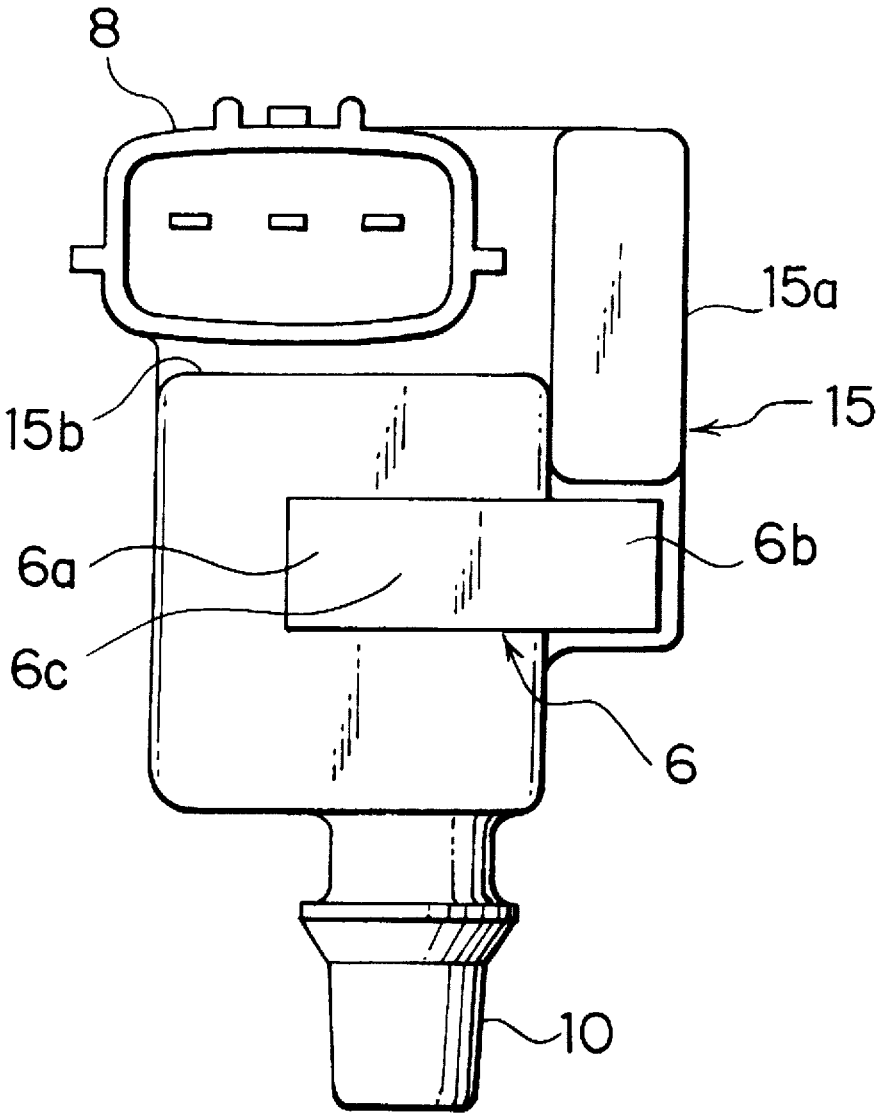
FIG. 2 is a backside view showing the ignition apparatus for an internal combustion engine according to the embodiment 1 the present invention.
Figure 3:
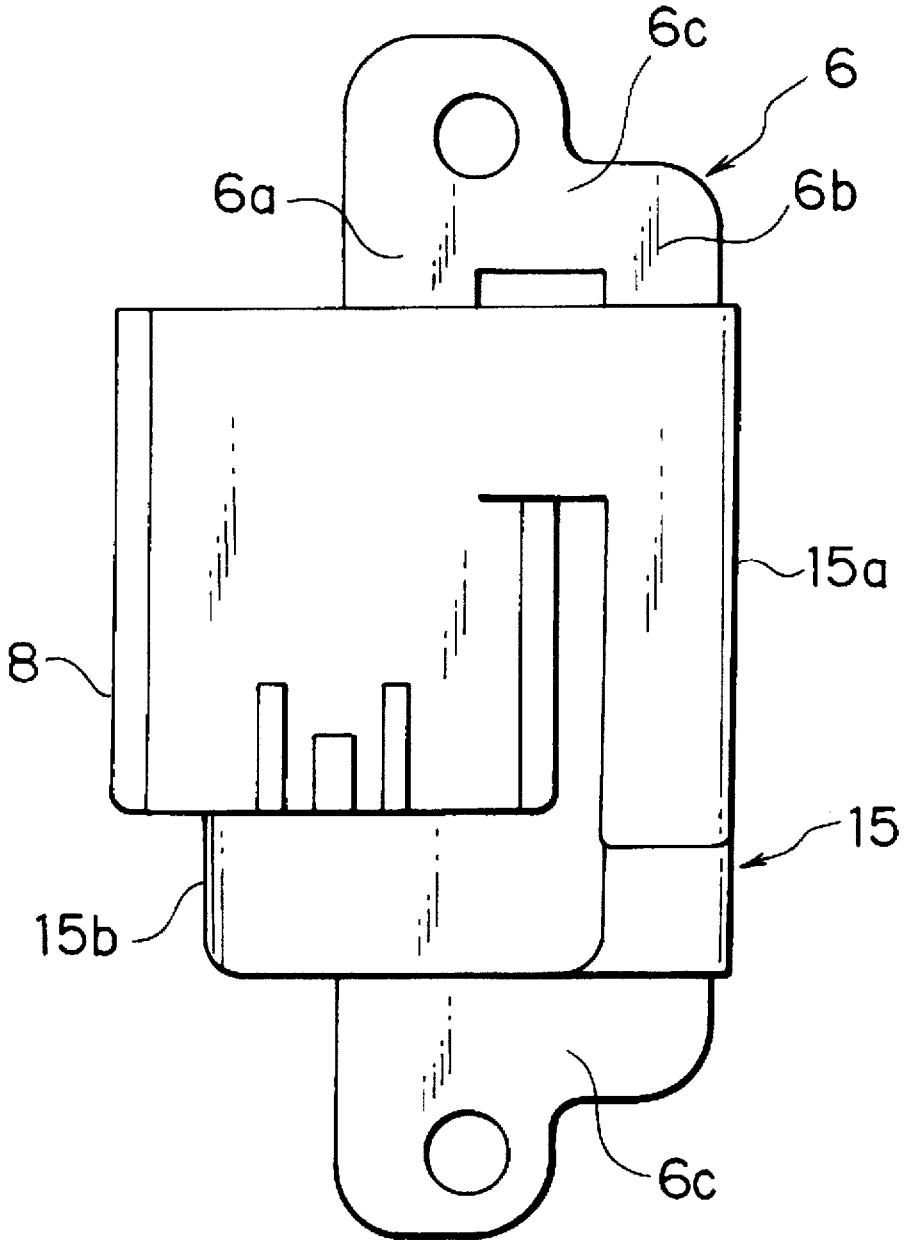
FIG. 3 is a top view showing the ignition apparatus for an internal combustion engine according to the embodiment 1 of the present invention.
Figure 9:
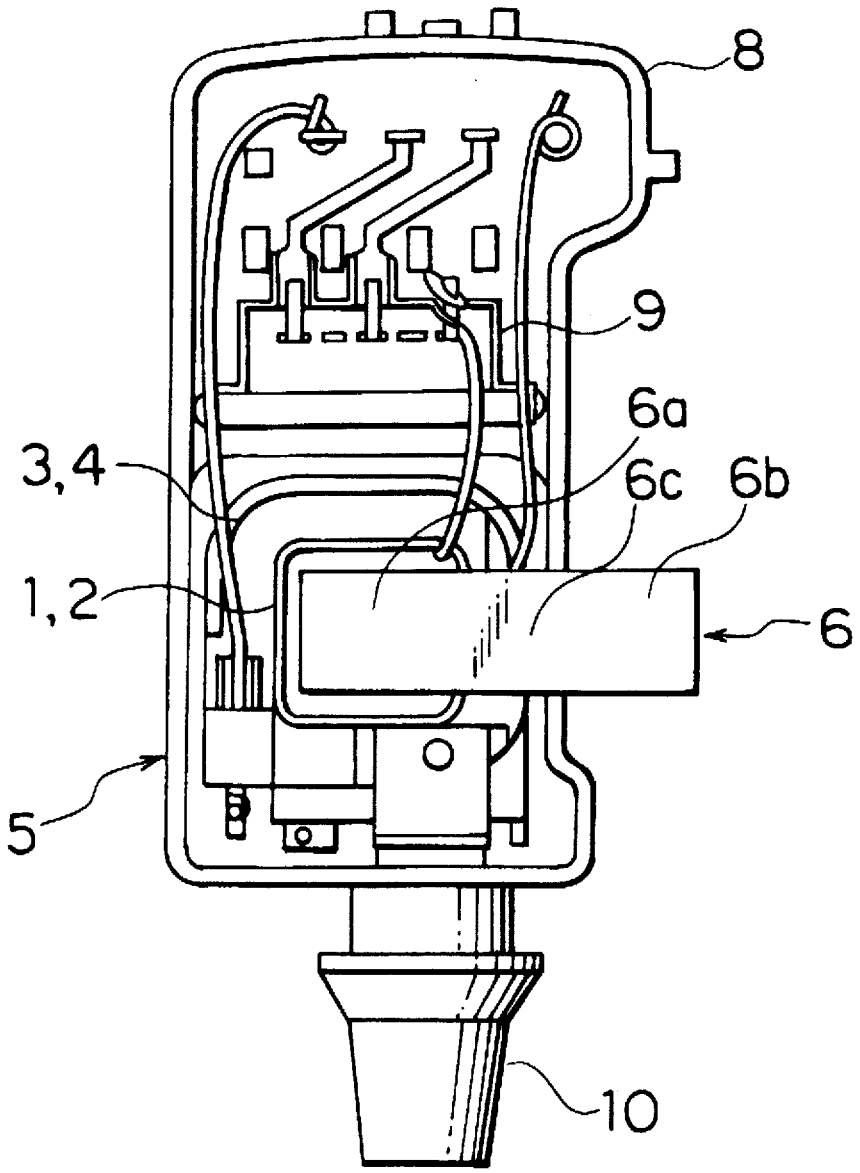
FIG. 9 PRIOR ART
FIG. 9 is a front view showing a conventional ignition apparatus for an internal combustion engine with a molding resin removed.
Figure 10:
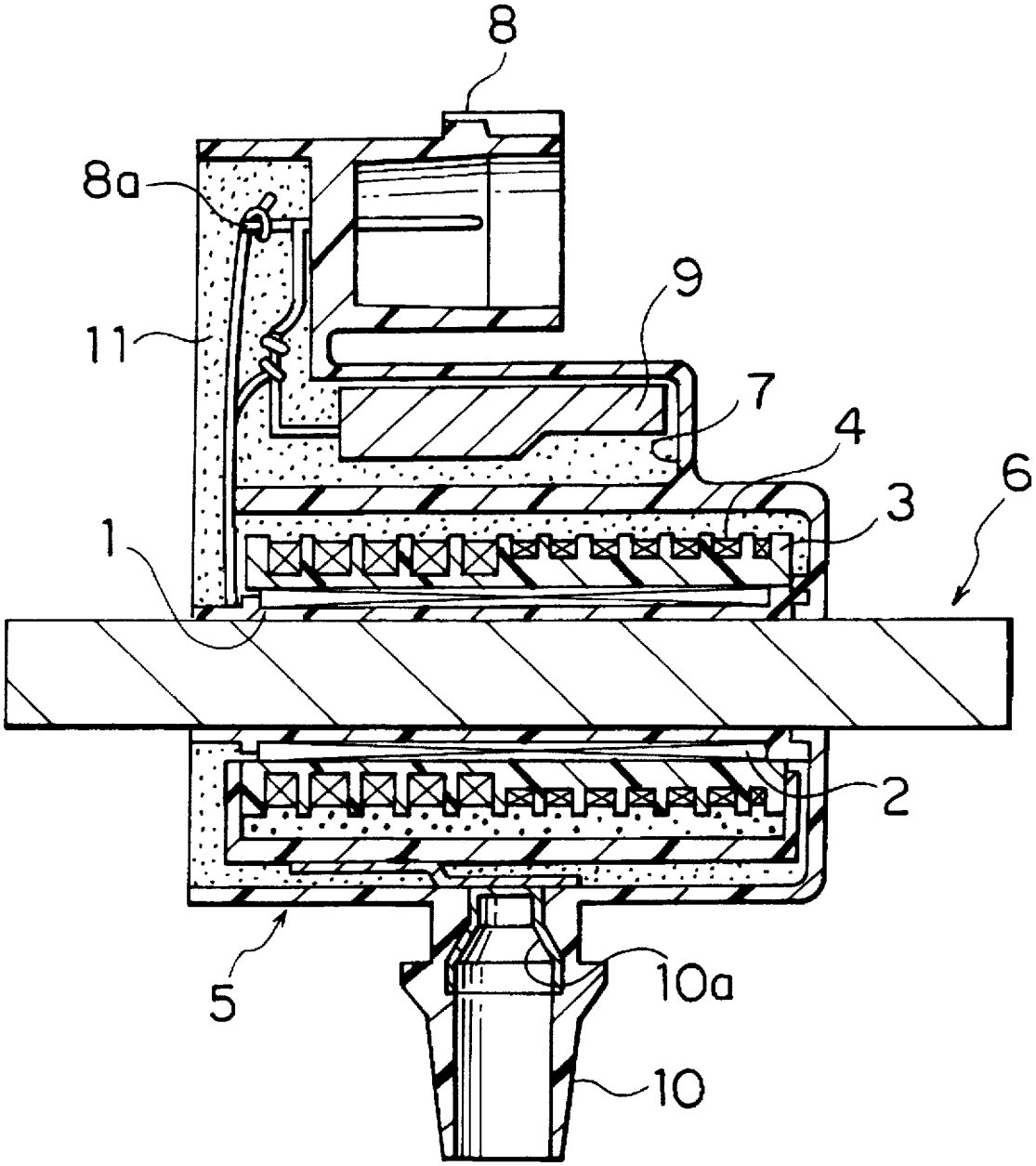
FIG. 10 PRIOR ART
FIG. 10 is a side cross sectional view showing the conventional ignition apparatus for an internal combustion engine.
Figure 11:
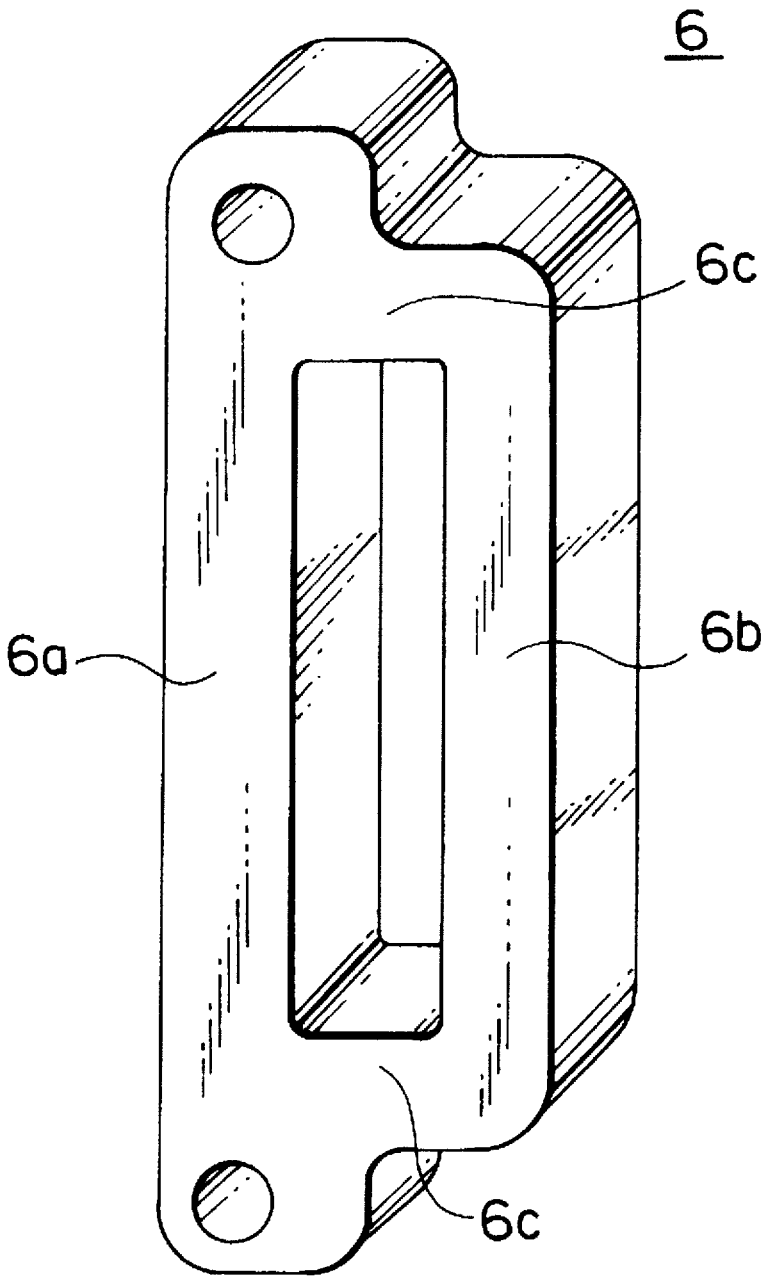
FIG. 11 PRIOR ART
FIG. 11 is a perspective view showing an example of a magnetic core of a closed magnetic circuit used in the ignition apparatus for an internal combustion engine.

FIG. 1 is a front view showing an ignition apparatus for an internal combustion engine according to an embodiment 1 of the present invention with a molding resin removed, FIG. 2 is a backside view showing the ignition apparatus for an internal combustion engine according to the embodiment 1 of the present invention and FIG. 3 is a top view showing the ignition apparatus for an internal combustion engine according to the embodiment 1 of the present invention. The same numerals as used in FIG. 9 and FIG. 10 are used in these drawings to denote portions which are the same as or corresponding to portions used in the conventional ignition apparatus for an internal combustion engine and the description of these parts is omitted.

In the above drawings, an outer case 15 is composed of a resin material such as PBT and formed with a module accommodating portion 15*a* for accommodating a switching module 9 and a case main portion 15*b* for accommodating a primary coil 2, a secondary coil 4 and the center core 6*a* of a core 6. The module accommodating portion 15*a* is disposed to be overlapped with a side core 6*b* of a core 6 as viewed in the axial direction of the core 6. A connector 8 is disposed integrally with the outer case 15 so that it is located externally of a secondary bobbin 3 and overlapped with the center core 6*a* of the core 6 as viewed in the axial direction of the core 6 as well as overlapped with the module accommodating portion 15*a* as viewed in a direction perpendicular to the axial direction of the core 6. Thus, the connector 8 is located in a space which is in contact with the secondary coil 4 and switching module 9. Further, a high-tension tower 10 is disposed integrally with the outer case 15 so that it confronts or opposes the connector 8 across the center core 6*a* of the core 6.

Note, the other elements of the embodiment 1 are arranged as that of the above conventional ignition apparatus for an internal combustion engine.

In the ignition apparatus for an internal combustion engine arranged as described above, the coil unit, which is composed of the primary coil 2 and the secondary coil 4, and the switching module 9 are disposed without confronting each other. Therefore, the heat generated at the coil unit and the switching module 9 does not almost act to each other. Then, at least three fourths of the surface area of the switching module 9 extends closely along the outer wall of the outer case 15. Therefore, the heat generated at the coil unit and the switching module 9 by current feed is radiated to the outside from the surface of the molding resin 11 therethrough as well as transmitted to the outer case 15 through the molding resin 11 and radiated to the outside from the outer case 15. As a result, the heat generated at the coil unit and the switching module 9 is promptly radiated without being accumulated in the apparatus.

Further, since the switching module 9 can be disposed in the vicinity of the side core 6*b* of the core 6, the size of the apparatus can be reduced. In addition, since the connector 8 is located in the space which is in contact with the secondary coil 4 and the switching module 9, the switching module 9, the connector 8 and the high-tension tower 10 are not disposed to be overlapped with each other across the center core 6*a* of the core 6 as viewed in the axial direction of the core 6 contrary to the conventional ignition apparatus for an internal combustion engine and thus the outside shape of the apparatus is not greatly projected in a single direction and the size of the apparatus can be reduced accordingly. Consequently, the layout property for mounting the apparatus is improved and the apparatus can be easily mounted even under such a mounting environment that the dimension of the periphery of a portion where the apparatus is to be mounted is so strictly limited that the apparatus cannot project in both a height direction and a width direction.

Note, although the embodiment 1 is described supposing that the module accommodating portion 15*a* is provided with the outer case 15 and the switching module 9 is accommodated in the module accommodating portion 15*a*, the switching module 9 need not be always accommodated in the outer case 15 so long as it achieves the above positional relationship when it is disposed, and the switching module 9 may be disposed, for example, on the outside wall of the outer case 15.

Further, although the embodiment 1 is described supposing that the switching module 9 as the heat generating unit is accommodated in the outer case 15, other circuit substrates on which an ON voltage preventing diode and a heating element are mounted as a current feed unit can obtain the same advantage.

Embodiment 2

Figure 4:
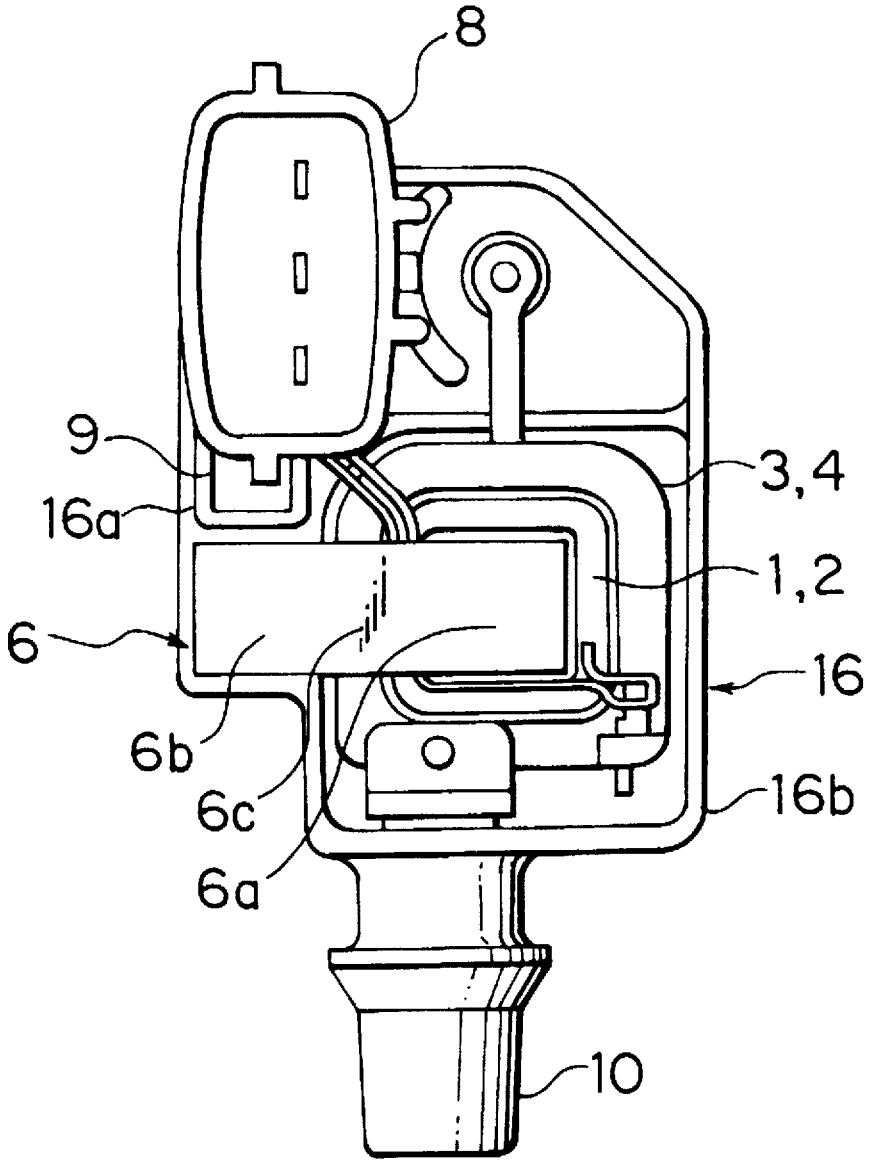
FIG. 4 is a front view showing an ignition apparatus for an internal combustion engine according to an embodiment 2 of the present invention with a molding resin removed.
Figure 5:
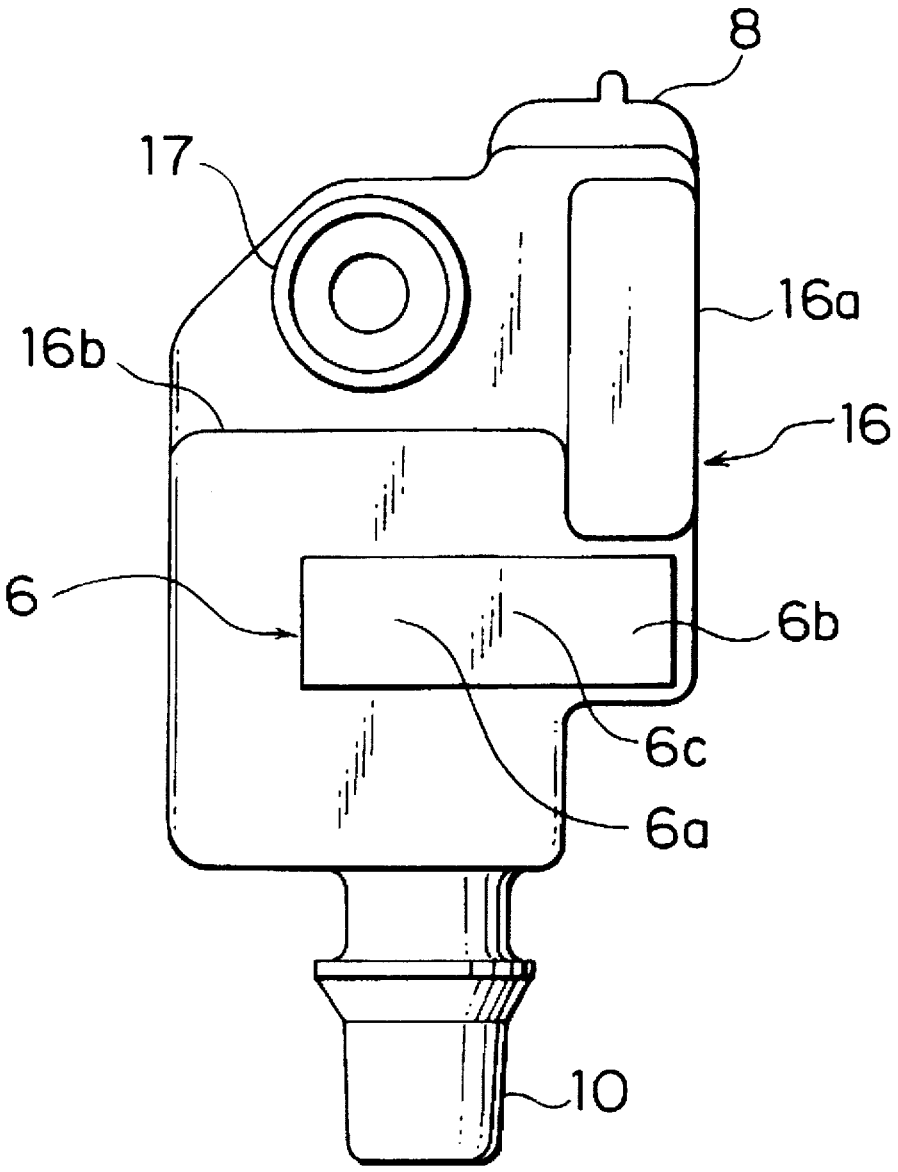
FIG. 5 is a backside view showing the ignition apparatus for an internal combustion engine according to the embodiment 2 of the present invention.
Figure 6:
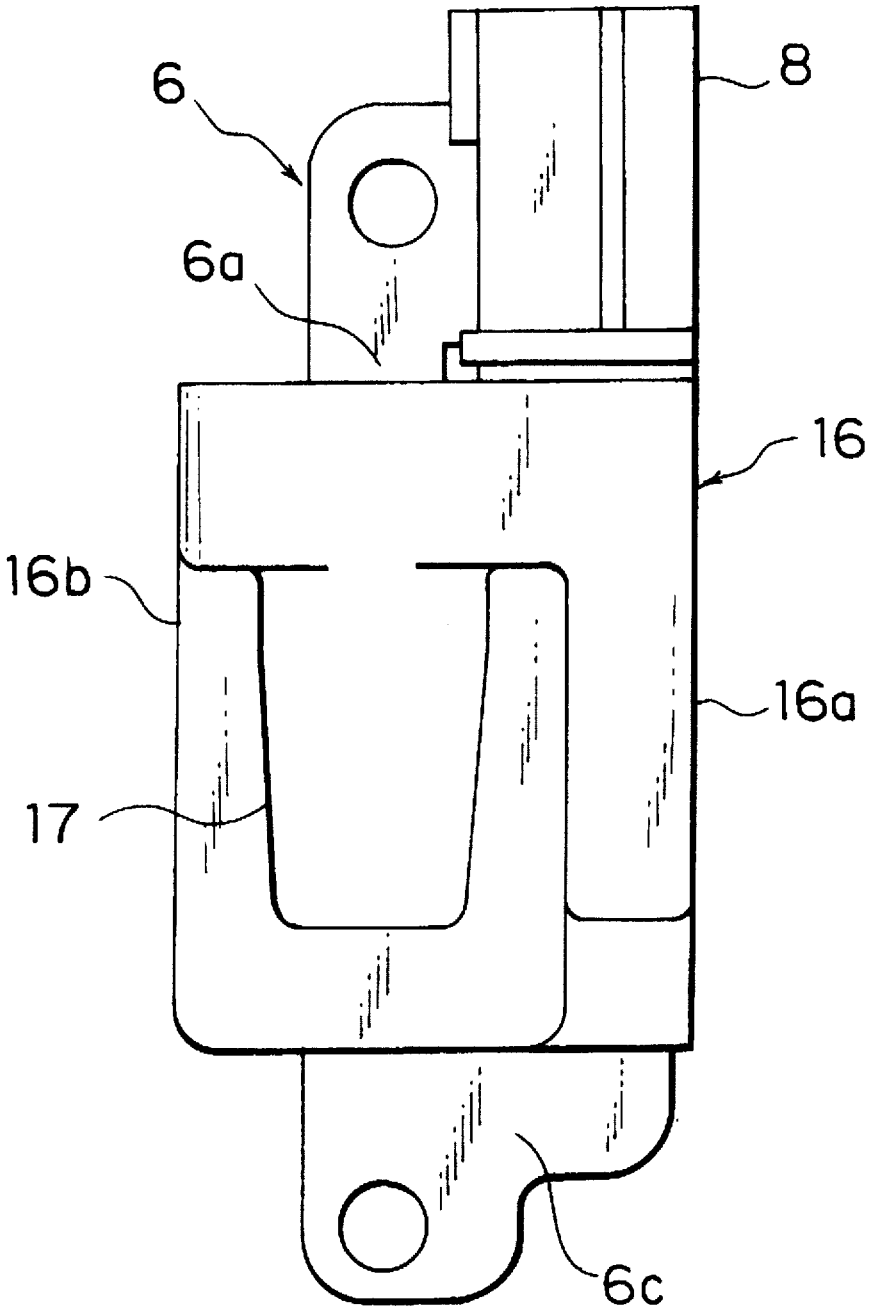
FIG. 6 is a top view showing the ignition apparatus for an internal combustion engine according to the embodiment 2 of the present invention.

FIG. 4 is a front view showing an ignition apparatus for an internal combustion engine according to an embodiment 2 of the present invention with a molding resin removed, FIG. 5 is a backside view showing the ignition apparatus for an internal combustion engine according to the embodiment 2 of the present invention and FIG. 6 is a top view showing the ignition apparatus for an internal combustion engine according to the embodiment 2 of the present invention.

In the above drawings, an outer case 16 is composed of a resin material such as PBT and formed with a module accommodating portion 16*a* for accommodating a switching module 9 and a case main portion 16*b* for accommodating a primary coil 2, a secondary coil 4 and the center core 6*a* of a core 6. The module accommodating portion 16*a* is disposed to be overlapped with the side core 6*b* of the core 6 as viewed in the axial direction of the core 6. A connector 8 is disposed integrally with the outer case 16 in such a manner that the switching module 9 is accommodated in the module accommodating portion 16*a* in the state that the connector 8 is wired to the switching module 9 and thereafter a molding resin 11 is molded. Further, a high-tension tower 10 is disposed integrally with the outer case 15 so that it confronts the connector 8 across the center core 6*a* of the core 6. Further, another high-tension tower 17 is disposed integrally with the outer case 16 so that it is located externally of a secondary bobbin 3 and overlapped with the center core 6*a* of the core 6 as viewed in the axial direction of the core 6 as well as overlapped with the module accommodating portion 16*a* as viewed in a direction perpendicular to the axial direction of the core 6. Thus, the high-tension tower 17 is located in a space which is in contact with the secondary coil 4 and the switching module 9.

Note, the other elements of embodiment 2 are the same as that of the above embodiment 1.

In the ignition apparatus for an internal combustion engine arranged as described above, since the coil unit, which is composed of the primary coil 2 and the secondary coil 4, and the switching module 9 are disposed without confronting each other, the size of the apparatus can be reduced likewise the above embodiment 1 as well as a radiating property can be improved.

Further, since the switching module 9, the connector 8 and the high-tension tower 10 are not disposed to be overlapped with each other across the center core 6*a* of the core 6 as viewed in the axial direction of the core 6 contrary to the conventional ignition apparatus for internal combustion engine, the outside shape of the apparatus is not greatly projected in a direction and thus the size of the apparatus can be reduced and the layout property for mounting the apparatus is improved likewise the above embodiment 1.

Further, since the high-tension tower 17 can be disposed in a space which is in contact with the secondary coil 4 and the switching module 9, the size of the apparatus can be reduced even in an internal combustion engine provided with the two high-tension towers 10 and 17.

Note, although the above embodiment 2 describes the ignition apparatus for an internal combustion engine provided with the two high-tension towers 10 and 17, the same advantage can be obtained even if the embodiment 2 is applied to an ignition apparatus for an internal combustion engine provided with three or more high-tension towers.

Further, when an ignition apparatus for an internal combustion engine is provided with a single high-tension tower, it suffices to dispose the high-tension tower together integrally with the outer case 16 at a position where the high-tension tower is overlapped with the center core 6*a* of the core 6 as viewed in the axial direction of the core 6 as well as overlapped with the module accommodating portion 16*a* as viewed in a direction perpendicular to the axial direction of the core 6.

Embodiment 3

Figure 7:
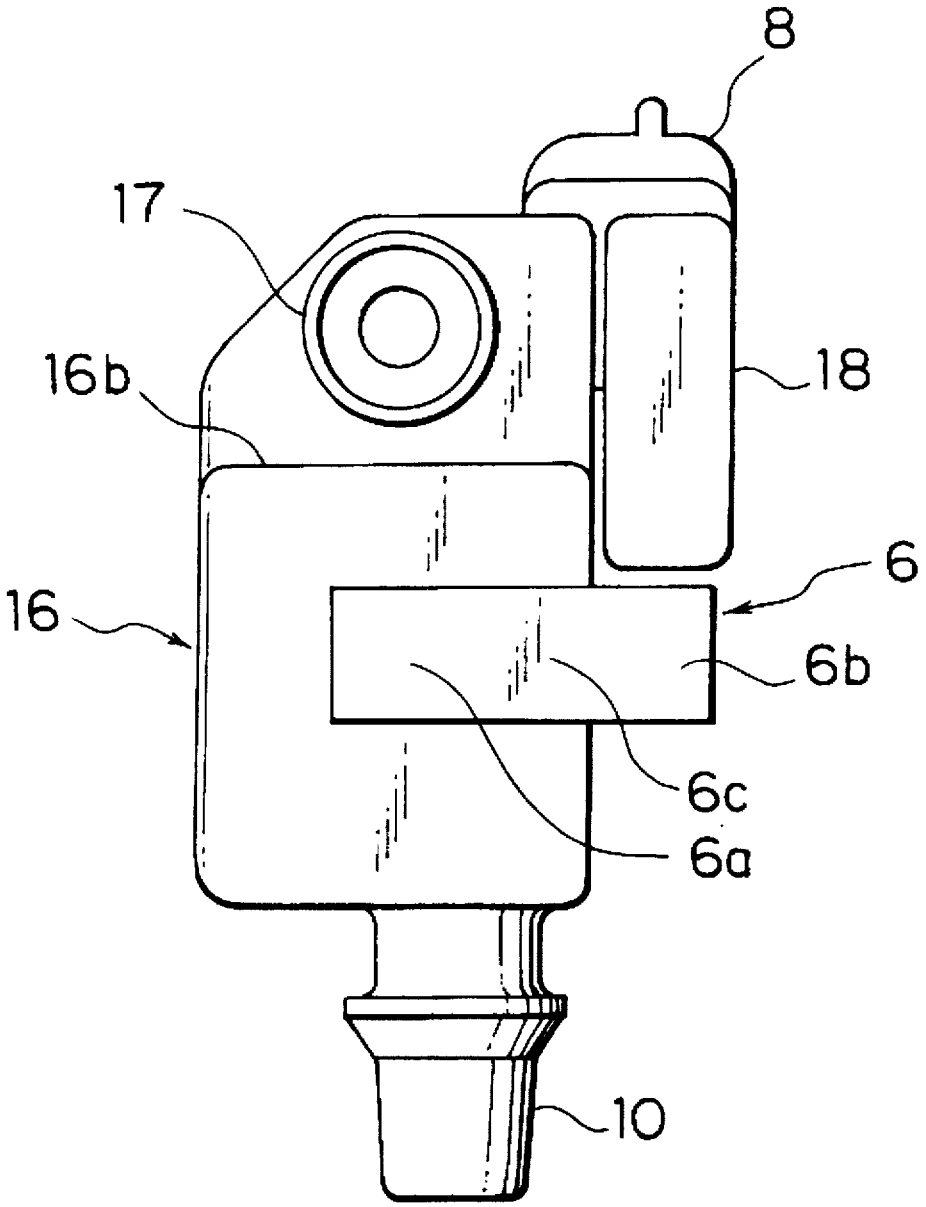
FIG. 7 is a backside view showing an ignition apparatus for an internal combustion engine according to an embodiment 3 of the present invention.
Figure 8:
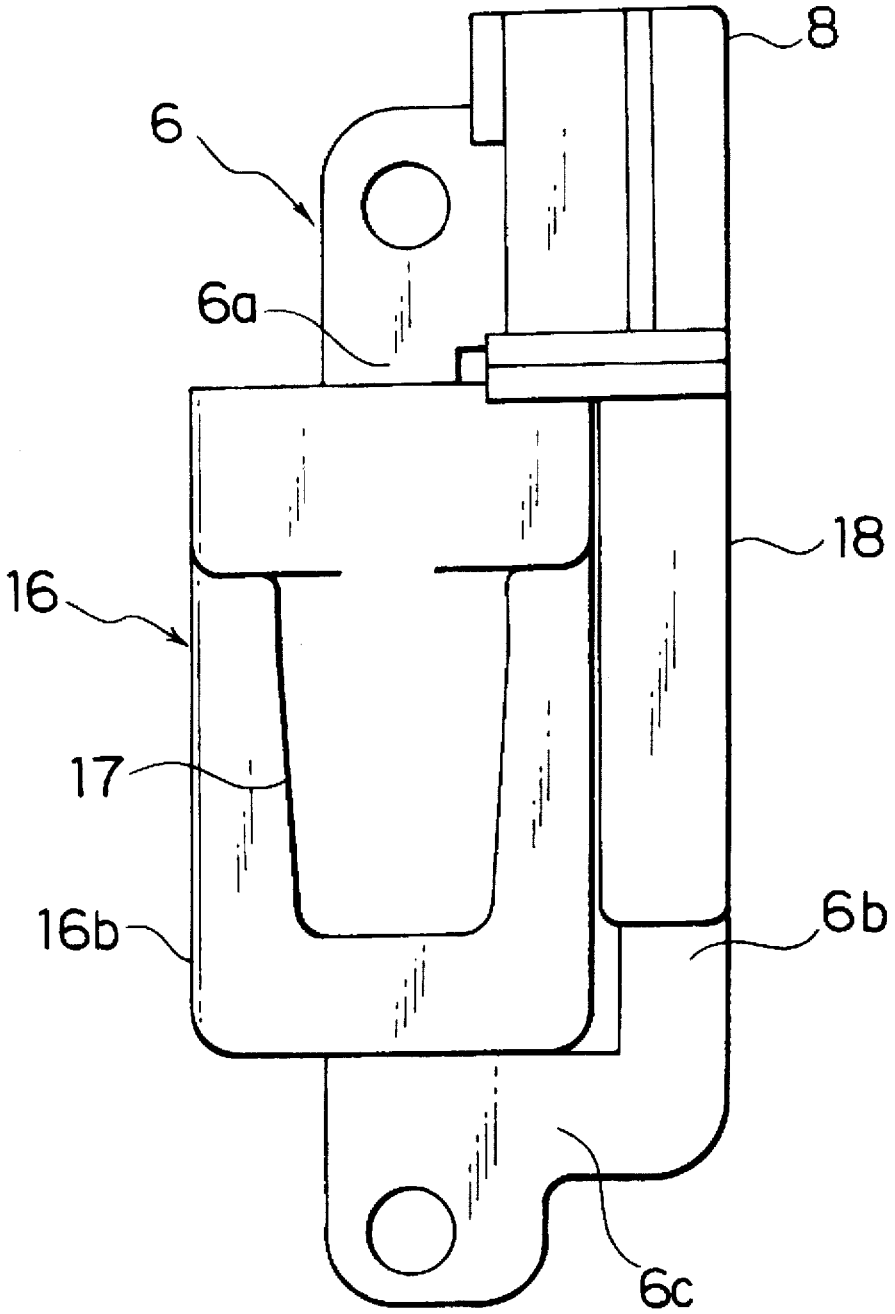
FIG. 8 is a top view showing the ignition apparatus for an internal combustion engine according to the embodiment 3 of the present invention.

Although the above embodiment 2 disposes the module accommodating portion 16*a* at the position where it is overlapped with the side core 6*b* of the core 6 as viewed in the axial direction of the core 6*b* of the outer case 16 and accommodates the switching module 9 in the module accommodating portion 16*a*, an embodiment 3 achieve the same advantage by mounting a switching module accommodating member 18 in which an switching module 9 is accommodated at a position where the switching module accommodating member 18 is overlapped with the side core 6*b* of a core 6 as viewed in the axial direction of the core 6 of the outside wall of an outer case 16 as shown in FIG. 7 and FIG. 8.

Since the present invention is arranged as described above, it achieves the following advantages.

According to the present invention, since the switching module is disposed at the position where it is overlapped with the side core as viewed in the axial direction of the core, the switching module can be disposed in the vicinity of the side core of the core and heat generated at the switching module and coil unit is sufficiently spaced apart.

The ignition apparatus can be made small in size and while maintaining excellent radiation properties.

According to the present invention, since the connector is located at the position where it is overlapped with the center core as viewed in the axial direction of the core as well as overlapped with the switching module as viewed in a direction perpendicular to the axial direction of the core, the outside dimension of the core can be reduced in the axial direction thereof so as to reduce the size of the apparatus.

Further, according to the present invention, since the high-tension tower is located at the position where it is overlapped with the center core as viewed in the axial direction of the core as well as overlapped with the switching module as viewed in a direction perpendicular to the axial direction of the core, the outside dimension of the core can be reduced in the axial direction thereof so as to reduce the size of the apparatus.

What is claimed is:

1. An ignition apparatus for an internal combustion engine comprising:

a magnetic core of a closed magnetic circuit arranged to an annular shape by connecting a center core to a side core by connecting cores at both ends of said connecting cores;

a primary coil wound around said center core;

a secondary coil concentrically wound eternally of said primary coil, so as to be adjacent to the side core;

an outer case for accommodating said center core, said primary coil and said secondary coil;

a molding resin filled in said outer case;

a connector having an external terminal electrically connected to said primary coil and feeding a primary current from an external power unit;

a switching module for intermittently feeding said primary current in accordance with an ignition timing, said switching module being located at a position where it is overlapped with said side core as viewed in the axial direction of said magnetic core; and a high-tension tower having a high-tension terminal electrically connected to said secondary coil and outputting a high-tension voltage, said high-tension tower being located at a position where it is overlapped with said center core as viewed in the axial direction of said magnetic core as well as being overlapped with said switching module as viewed in a direction perpendicular to the axial direction of said magnetic core.

2. The ignition apparatus according to claim 1, wherein said switching module is located outside of said outer case.

3. An ignition apparatus for internal combustion engine comprising:

a magnetic core of a closed magnetic circuit arranged to an annular shape by connecting a center core to a side core by connecting cores at both ends of said connecting cores;

a primary coil wound around said center core;

a secondary coil concentrically wound externally of said primary coil;

an outer case for accommodating said center core, said primary coil and said secondary coil;

a molding resin filled in said outer case;

a connector having an external terminal electrically connected to said primary coil and feeding a primary current from an external power unit;

a switching module for intermittently feeding said primary current in accordance with an ignition timing said switching module being located within said outer case at a position where it is overlapped with said side core as viewed in the axial direction of said magnetic core; and a high-tension tower having a high-tension terminal electrically connected to said secondary coil and outputting a high-tension voltage, said high-tension tower being located at a position where it is overlapped with said center core viewed in the axial direction of said magnetic core as well as being overlapped with said switching module as viewed in a direction perpendicular to the axial direction of said magnetic core.

4. An ignition apparatus for an internal combustion engine comprising:

a magnetic core of a closed magnetic circuit arranged to an annular shape by connecting a center core to a side core by connecting cores at both ends of said connecting cores;

a primary coil wound around said center core;

a secondary coil concentrically wound eternally of said primary coil;

an outer case for accommodating said center core said primary coil and said secondary coil;

a molding resin filled in said outer case;

a connector having an external terminal electrically connected to said primary coil and feeding a primary current from an external power unit;

a switching module for intermittently feeding said primary current in accordance with an ignition timing, said switching module being located at a position where it is overlapped with said side core as viewed in the axial direction of said magnetic core that at least three-fourths of the surface area of said switching module extends along said outer case; and a high-tension tower having a high-tension terminal electrically connected to said secondary coil and outputting a high-tension voltage, said high-tension tower being located at a position where it is overlapped with said center core as viewed in the axial direction of said magnetic core as well as being overlapped with said switching module as viewed in a direction perpendicular to the axial direction of said magnetic core.

5. An ignition apparatus for an internal combustion engine comprising:

a magnetic core of a closed magnetic circuit arranged to an annular shape by connecting a center core to a side core by connecting cores at both ends of said connecting cores;

a primary coil wound around said center core;

a secondary coil concentrically wound externally of said primary coil;

an outer case for accommodating said center core, said primary coil and said secondary coil;

a molding resin filled in said outer case;

a connector having an external terminal electrically connected to said primary coil and feeding a primary current from an external power unit;

a switching module for intermittently feeding said primary current in accordance with an ignition timing, said switching module being located at a position where it is substantially entirely overlapped with said side core as viewed in the axial direction of said magnetic core; and a high-tension tower having a high-tension terminal electrically connected to said secondary coil and outputting a high-tension voltage, said high-tension tower being located at a position where it is overlapped with said center core as viewed in the axial direction of said magnetic core as well as being overlapped with said switching module as viewed in a direction perpendicular to the axial direction of said magnetic core.

6. An ignition apparatus for an internal combustion engine comprising: a magnetic core of a closed magnetic circuit arranged to an annular shape by connecting a center core to a side core by connecting cores at both ends of said connecting cores;

a primary coil wound around said center core;

a secondary coil concentrically wound externally of said primary coil;

an outer case for accommodating said center core, said primary coil and said secondary coil; a molding resin filled in said outer case;

a connector having an external terminal electrically connected to said primary coil and feeding a primary current from an external power unit;

a switching module for intermittently feeding said primary current in accordance with an ignition timing, said switching module being located at a position where it is overlapped with said side core and not overlapped with said coils as viewed in the axial direction of said magnetic core; and a high-tension tower having a high-tension terminal electrically connected to said secondary coil and outputting a high-tension voltage, said high-tension tower being located at a position where it is overlapped with said center core as viewed in the axial direction of said magnetic core as well as being overlapped with said switching module as viewed in a direction perpendicular to the axial direction of said magnetic core.

* * * * *